US011971192B2

(12) United States Patent
Davtyan

(10) Patent No.: US 11,971,192 B2
(45) Date of Patent: Apr. 30, 2024

(54) ENVIRONMENTAL CONTROL UNIT INCLUDING NOISE REDUCTION FEATURES

(71) Applicant: Robert Bosch GmbH, Stuttgart (DE)

(72) Inventor: Armen Davtyan, Ashland, MA (US)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 1311 days.

(21) Appl. No.: 16/508,007

(22) Filed: Jul. 10, 2019

(65) Prior Publication Data

US 2021/0010715 A1 Jan. 14, 2021

(51) Int. Cl.
*F24F 13/20* (2006.01)
*F24F 13/24* (2006.01)

(52) U.S. Cl.
CPC ..... *F24F 13/24* (2013.01); *F24F 13/20* (2013.01)

(58) Field of Classification Search
CPC .... F24F 13/24; F24F 13/20; F24F 1/10; F24F 1/12; F24F 1/40; F24F 2013/202; F24F 2013/242; F24F 2013/247; G10K 11/168; G10K 2210/109; B32B 15/14; F04B 39/0033
USPC ..... 181/200, 198, 207, 229; 454/262
See application file for complete search history.

(56) References Cited

U.S. PATENT DOCUMENTS 1,610,774 A * 12/1926 Hanson ..... G10F 1/02 417/363
3,714,795 A * 2/1973 Fowell ..... F24F 1/16 62/181
3,856,439 A * 12/1974 Moehrbach ..... F04B 39/06 181/204
4,258,821 A * 3/1981 Wendt ..... F04C 29/066 181/258

(Continued)

FOREIGN PATENT DOCUMENTS

CN 203869238 10/2014
CN 105571103 5/2016

(Continued)

OTHER PUBLICATIONS

Xu, Qian, CN106679238 Translation.pdf, "Sound insulation material, compressor and air conditioner", May 2017, pp. 1-10.*

(Continued)

*Primary Examiner* — Avinash A Savani
*Assistant Examiner* — Ryan L Faulkner
(74) *Attorney, Agent, or Firm* — Kelly McGlashen; Maginot, Moore & Beck LLP

(57) ABSTRACT

An environmental control unit, such as an HVAC or heat pump unit, includes a housing, and a blower disposed in the housing, the blower configured to draw air into the housing via an air inlet and exhaust air from the housing via an air outlet. The unit includes a heat exchanger disposed in the housing between the air inlet and the blower, and a compressor disposed within housing. The unit include features that reduce noise emitted from the compressor. The noise (Continued)

reduction features include a noise-reducing enclosure that encapsulates the compressor. The enclosure includes a rigid metal shell, an outer insulating structure fixed to an outside surface of the shell, and an inner insulating structure fixed to an inside surface of the shell.

18 Claims, 8 Drawing Sheets

(56) References Cited

U.S. PATENT DOCUMENTS 4,264,282 A * 4/1981 Crago ..... F04B 39/0038 417/243
4,311,439 A * 1/1982 Stofen ..... F04B 39/16 417/313
4,982,812 A * 1/1991 Hwang ..... F24F 13/24 415/119
4,991,406 A * 2/1991 Fujii ..... F24F 1/40 62/259.1
5,151,018 A * 9/1992 Clendenin ..... F04B 39/0033 417/313
5,272,285 A * 12/1993 Miller ..... F04C 29/066 181/202
5,274,200 A * 12/1993 Das ..... E04B 1/8218 415/119
5,588,810 A * 12/1996 DiFlora ..... F04B 39/0033 181/403
5,672,052 A * 9/1997 Ishida ..... F04D 29/664 417/423.5
5,965,851 A * 10/1999 Herreman ..... B32B 11/10 181/290
5,997,258 A * 12/1999 Sawyer, III ..... F04B 39/0044 417/902
6,062,033 A * 5/2000 Choi ..... F04B 39/0033 62/296
6,932,190 B2 * 8/2005 Sishtla ..... F16L 55/0336 181/290
7,357,219 B2 * 4/2008 Mafi ..... F24F 1/12 181/290
7,398,855 B2 * 7/2008 Seel ..... F01C 21/10 181/202
8,434,591 B2 * 5/2013 Cherniak ..... E04B 1/86 181/294
9,153,225 B2 * 10/2015 Bonifas ..... G10K 11/16
9,777,944 B2 * 10/2017 Mehta ..... F24F 13/24
2004/0042905 A1 * 3/2004 Stallings ..... F04B 39/0033 417/313
2007/0149076 A1 * 6/2007 Van Moeseke ..... B32B 15/02 442/52
2011/0290583 A1 * 12/2011 Kamikawa ..... B32B 17/02 181/200
2015/0192334 A1 * 7/2015 Hancock ..... F04C 29/04 415/177
2016/0003253 A1 * 1/2016 Lee ..... F04C 18/0207 417/420
2019/0003737 A1 * 1/2019 Hickey ..... F24F 13/20
2019/0139528 A1 * 5/2019 Lee ..... F04B 39/0033
2020/0139293 A1 * 5/2020 Ames ..... B01D 53/0415

FOREIGN PATENT DOCUMENTS

CN 105783156 7/2016
CN 106679238 A * 5/2017 ..... F24F 13/24
CN 108131729 A * 6/2018 ..... F24F 1/0007
CN 109026608 A * 12/2018 ..... F04B 39/0033
JP 2011052842 A * 3/2011
KR 101838077 B1 * 3/2018 ..... F04B 53/00
WO WO-2013046591 A1 * 4/2013 ..... F24F 1/12
WO WO-2018014482 A1 * 1/2018 ..... F24F 13/24

OTHER PUBLICATIONS

Mogi, Shuji, JP2011052842 Translation.pdf, "Heat pump outdoor unit", Mar. 2011, pp. 1-17.*
Acoustics Expert, CommercialAcoustics.pdf, "MLV Sound Barrier: EVA vs PVC Barriers", Oct. 2017, pp. 1-14, taken from https://commercial-acoustics.com/next-generation-mlv-mass-loaded-vinyls-potential-applications/ on Jun. 16, 2022.*
Second Skin, SecondSkin.pdf, "Second Skin Luxury Liner Pro—2 in 1 Sound Insulation for Cars—Mass Loaded Vinyl and Closed Cell Foam—MLV Noise Barrier", Jan. 2016, pp. 1-1, taken from https://www.amazon.com/Second-Skin-Luxury-Loaded-Deadener/dp/B01AVMR45U?th=1 on Jun. 16, 2022.*
Gao, Mingyun, CN10551103 Translation.pdf, "Silent noise reduction type ground source heat pump air conditioner", Nov. 2016, pp. 1-11.*
Hoshika, Keitrou, WO2013046591 Translation.pdf, "Outdoor unit", Apr. 2013, pp. 1-11.*
Ke, Sheng, CN108131729 Translation.pdf, "Air conditioner", Jun. 2018, pp. 1-12.*
Lee, Jung, KR101838077 Translation.pdf, "Soundproof cover of a compressor and air-conditioner including the same", Mar. 2018 , pp. 1-18.*
Xing, Zhigang, WO2018014482 Translation.pdf, "Cooling apparatus", Jan. 2018, pp. 1-71.*
Zhang, Lihua, CN_109026608_A_I_translation.pdf, "Compressor noise enclosure", Dec. 2018, pp. 1-5.*

* cited by examiner

ENVIRONMENTAL CONTROL UNIT INCLUDING NOISE REDUCTION FEATURES

BACKGROUND

The present invention relates to reducing noise emission in residential or commercial heating, ventilation and/or air conditioning (HVAC) or heat pump units.

Environmental control units such as HVAC or heat pump units are used in many heating and cooling applications to control the environment within a closed space. Some conventional heat pumps, for example, include a condensing heat exchanger and an evaporating heat exchanger disposed in a cabinet along with a compressor and a blower that is configured to draw air through the heat exchangers. Heating or cooling equipment such as an HVAC or heat pump unit employing a compressor and/or blower are known to produce undesirable noise. For example, the compressor noise, as well as the blower and airflow noise, of some residential/commercial HVAC or heat pump units may be transferred through the metal duct system to the living area or office spaces where such noise is undesirable. Moreover, HVAC or heat pump units, particularly residential units, are typically designed to be as compact as possible, and achieving noise reduction in a very confined space is challenging.

SUMMARY

In some aspects, a noise-reducing enclosure is provided for use in reducing noise emitted from a compressor. The enclosure is shaped and dimensioned to receive and enclose the compressor. The enclosure includes a rigid metal shell, an outer insulating structure fixed to an outside surface of the shell, and an inner insulating structure fixed to an inside surface of the shell.

In some embodiments, the outer insulating structure includes a first sheet of mass loaded plastic, and a first layer of foam insulation that is disposed between the first sheet of mass loaded plastic and the shell. In addition, the inner insulating structure includes a second sheet of mass loaded plastic, and a second layer of foam insulation. The second sheet of mass loaded plastic is disposed between the second layer of foam insulation and the shell.

In some embodiments, the shell includes: a shell first side; a shell second side; a shell third side; and a shell fourth side. The shell first side, the shell second side, the shell third side and the shell fourth side are arranged to provide a tube. In addition, the shell includes a shell cap that closes one end of the enclosure. The outer insulating structure includes: a cover first side that overlies the shell first side; a cover second side that overlies the shell second side; a cover third side that overlies the shell third side; a cover fourth side that overlies the shell fourth side; and a cap cover that overlies the shell cap. The inner insulating structure includes: a liner first side that underlies the shell first side; a liner second side that underlies the shell second side; a liner third side that underlies the shell third side; a liner fourth side that underlies the shell fourth side; and a cap liner that underlies the shell cap.

In some embodiments, each of the cover first side, the cover second side, the cover third side, the cover fourth side and the cap cover comprises a sheet of mass loaded plastic, and a layer of a foam insulation that is disposed between the sheet of mass loaded plastic and the shell.

In some embodiments, the In some embodiments, the sheet of mass loaded plastic is configured to provide at least one pound of mass for each square foot of the sheet.

In some embodiments, the sheet of mass loaded plastic is a sheet of mass loaded polyvinylchloride.

In some embodiments, each of the liner first side, the liner second side, the liner third side, the liner fourth side and the cap liner comprises a sheet of mass loaded plastic, and a layer of foam insulation, and the sheet of mass loaded plastic is disposed between the shell and the layer of foam insulation.

In some embodiments, the sheet of mass loaded plastic is configured to provide at least one pound of mass for each square foot of the sheet.

In some embodiments, the sheet of mass loaded plastic is a sheet of mass loaded polyvinylchlonde.

In some embodiments, the shell first side and the shell second side are joined along a first common edge to provide a first angled wall portion, the shell third side and the shell fourth side are joined along a second common edge to provide a second angled wall portion, the first angled wall portion is detachably connected to the second angled wall portion to form a tube, and the shell cap is detachably connected to the tube.

In some embodiments, the shell cap comprises an end plate, and a rim that protrudes from a peripheral edge of the shell cap toward the tube, and the rim abuts an outer surface of a portion of each of the shell first side, the shell second side, the shell third side and the shell fourth side.

In some embodiments, the outer insulating structure includes: a rim cover first side that cooperates with the cover first side to cover the entirety of the shell first side; a rim cover second side that cooperates with the cover second side to cover the entirety of the shell second side; a rim cover third side that cooperates with the cover third side to cover the entirety of the shell third side; and a rim cover fourth side that cooperates with the cover fourth side to cover the entirety of the shell fourth side.

In some embodiments, the enclosure has a first end, and a second end that is opposed to the first end and that is closed by the shell cap. The shell first side includes a first flange that is disposed at the enclosure first end and protrudes from a shell outward facing surface in a direction perpendicular to the shell outward facing surface. The shell second side includes a second flange that is disposed at the enclosure first end and protrudes from the shell outward facing surface in a direction perpendicular to the shell outward facing surface. The shell third side includes a third flange that is disposed at the enclosure first end and protrudes from the shell outward facing surface in a direction perpendicular to the shell outward facing surface, and the shell fourth side includes a fourth flange that is disposed at the enclosure first end and protrudes from the shell outward facing surface in a direction perpendicular to the shell outward facing surface.

In some embodiments, the shell, the outer insulating structure and the inner insulating structure cooperate to allow the enclosure to both block noise and prevent airflow through the enclosure.

In some aspects, an environmental control unit includes a housing including a first end that rests on a support surface, a closed second end that is spaced apart from the first end, a sidewall that extends between the first end and the second end, an air inlet, and an air outlet. The environmental control unit includes a blower disposed in the housing, the blower configured to draw air into the housing via the air inlet and exhaust air from the housing via the air outlet. The environmental control unit includes a heat exchanger disposed in the housing between the air inlet and the blower, and a compressor disposed within housing. The environmental control unit also includes noise reduction features. The noise reduction features include a noise-reducing enclosure that receives the compressor. The enclosure includes a rigid metal shell, an outer insulating structure fixed to an outside surface of the shell, and an inner insulating structure fixed to an inside surface of the shell.

In some embodiments, the outer insulating structure comprises: a first sheet of mass loaded plastic; and a first layer of foam insulation that is disposed between the first sheet of mass loaded plastic and the shell, and the inner insulating structure comprises: a second sheet of mass loaded plastic; and a second layer of foam insulation, and the second sheet of mass loaded plastic is disposed between the second layer of foam insulation and the shell.

In some embodiments, the first and second sheets of mass loaded plastic are configured to provide at least one pound of mass for each square foot of the sheet.

In some embodiments, each of the first and second sheets of mass loaded plastic is a sheet of mass loaded polyvinylchloride.

In some embodiments, the noise reduction features include vibration isolation structures that are disposed between the compressor and the housing.

In one aspect, an environmental control unit such as an HVAC or heat pump unit provides noise attenuation by reducing noise before it enters the duct system. This is achieved by surrounding the compressor with an encapsulating enclosure that provides sufficient structural mass to minimize or avoid propagation of noise radiated from the compressor through the walls of the heat pump housing. In addition, the enclosure is constructed to minimize air leaks and is secured to the heat pump housing first end, creating a substantially air tight structure which further improves the effectiveness of the sound reduction provided by the enclosure. As used herein, the term "substantially air tight" refers to a state in which air does not move freely or easily, and is nearly a hermetic state.

It is understood that the invention is not limited in its application to the details of construction and the arrangement of components set forth in the following description or illustrated in the following drawings. The invention is capable of other embodiments and of being practiced or of being carried out in various ways.

BRIEF DESCRIPTION OF THE FIGURES

In FIG. 1, solid lines represent cold fluid and broken lines represent hot fluid. In addition, narrow arrows represent refrigerant and wide arrows represent air or water as appropriate.

In FIG. 2, solid lines represent cold fluid and broken lines represent hot fluid. In addition, narrow arrows represent refrigerant and wide arrows represent air or water as appropriate.

DETAILED DESCRIPTION

Figure 1:
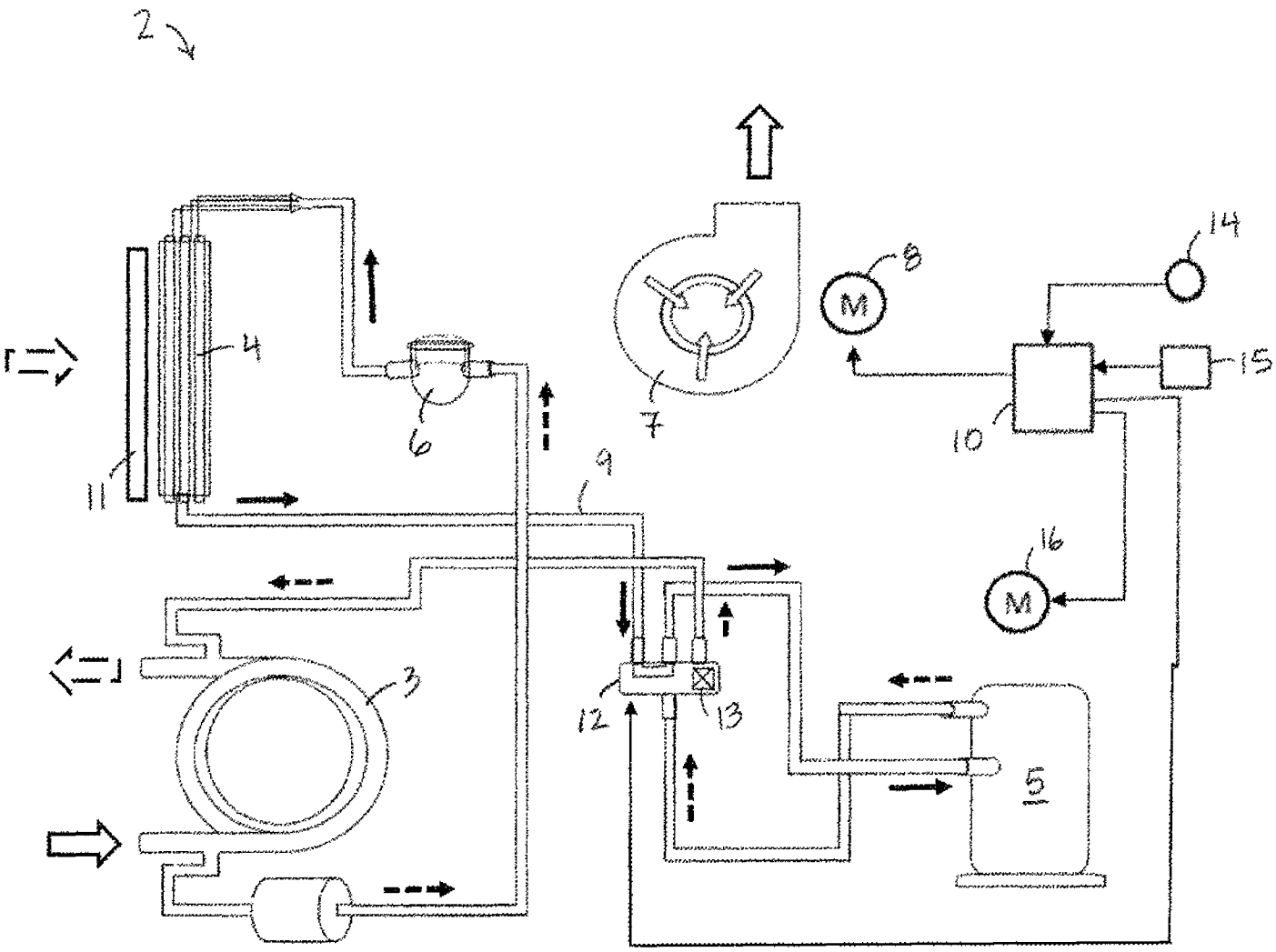
FIG. 1 is a schematic diagram of a heat pump, including arrows that represent fluid flow during a cooling operation of the heat pump.
Figure 2:
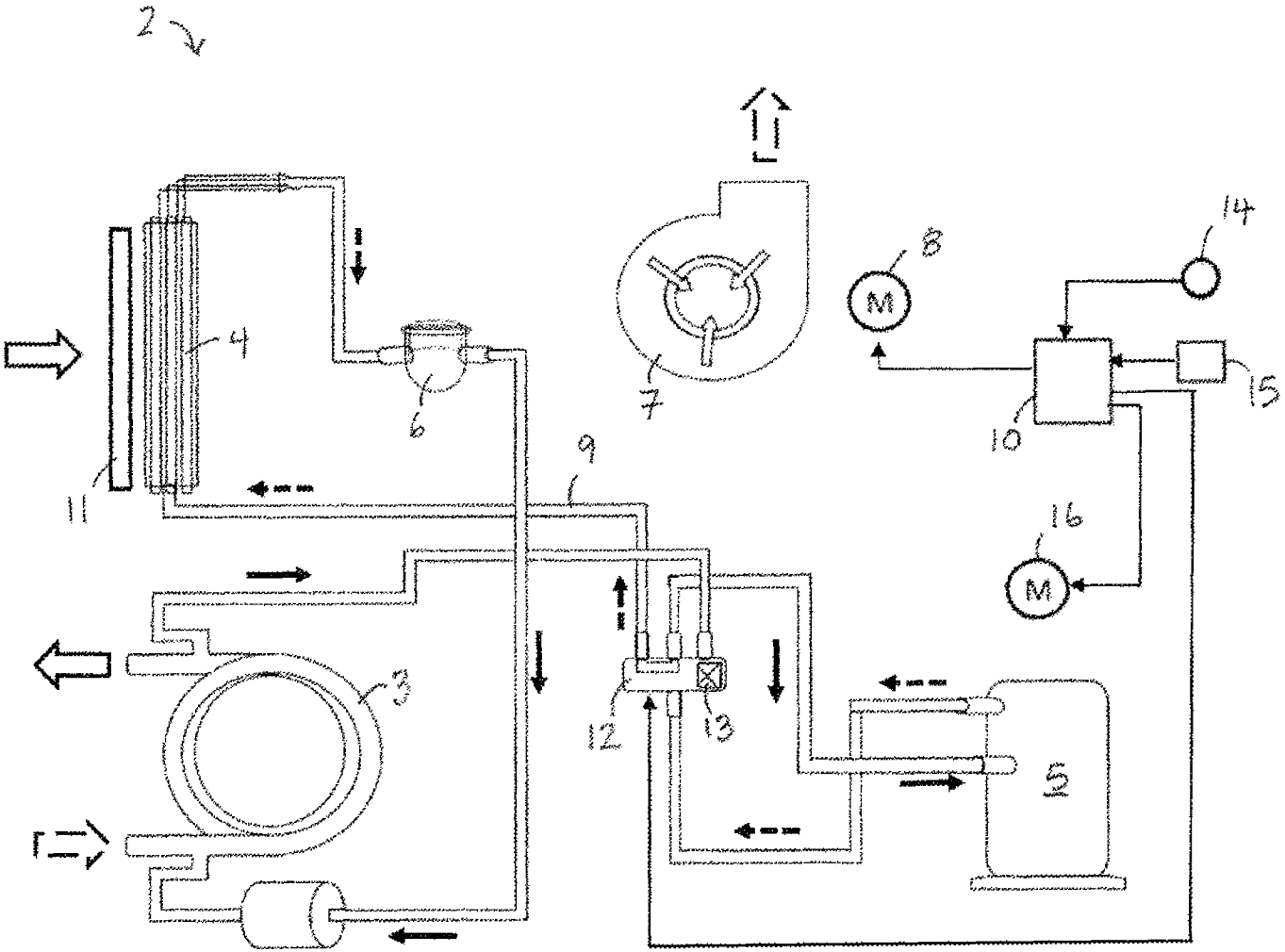
FIG. 2 is a schematic diagram of the heat pump of FIG. 1, including arrows that represent fluid flow during a heating operation of the heat pump.
Figure 4:
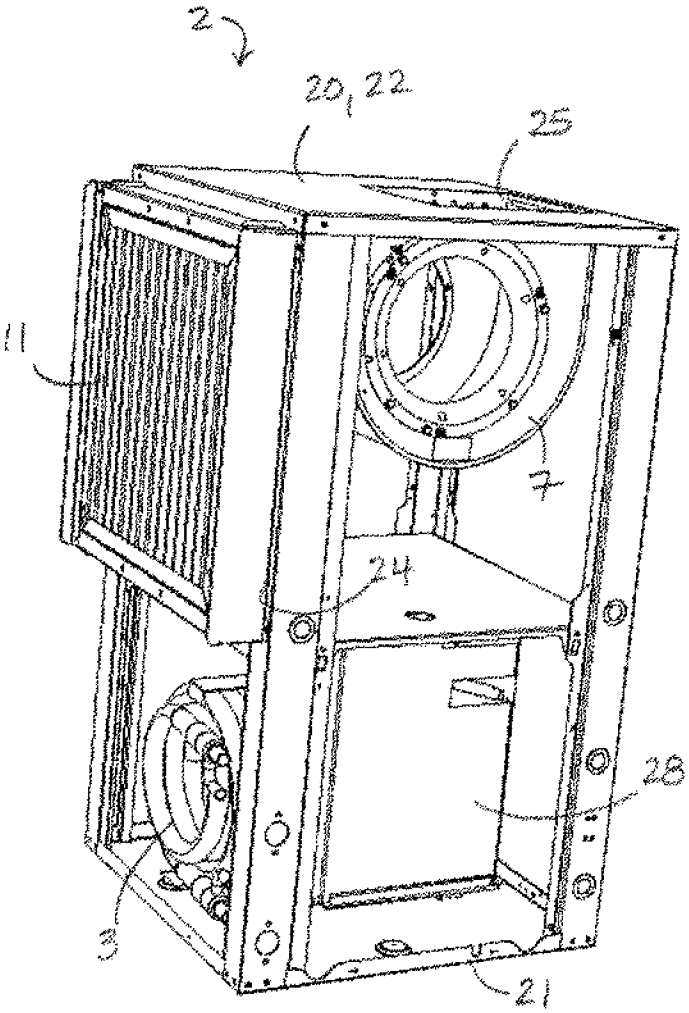
FIG. 4 is the perspective view of the heat pump of FIG. 3 shown with compressor enclosure included.
Figure 3:
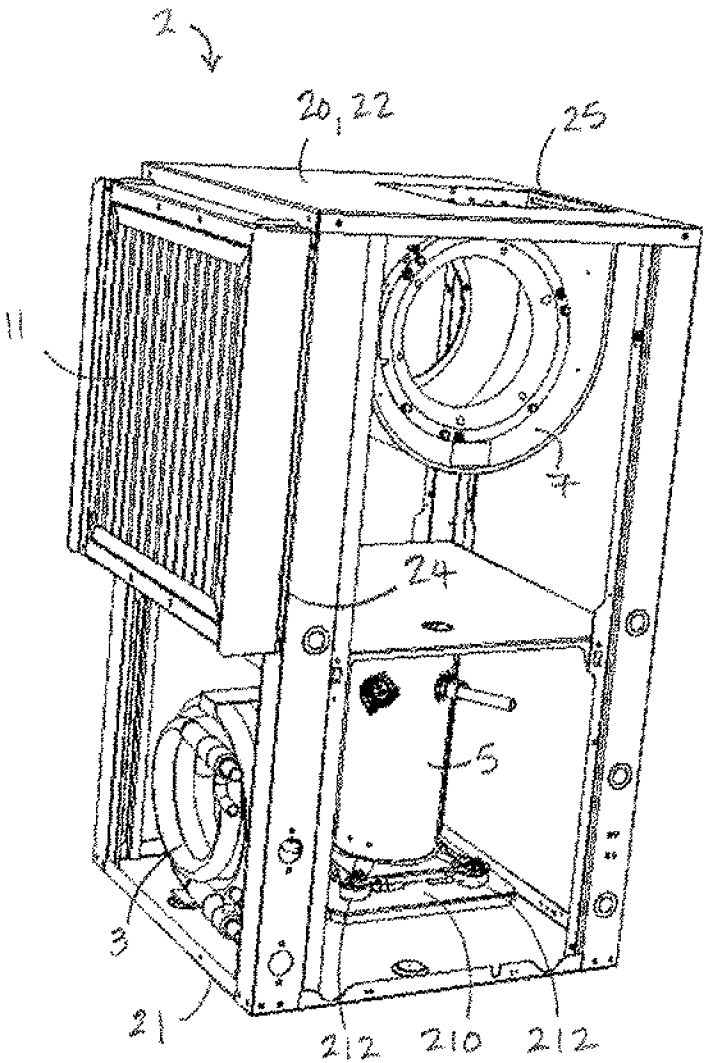
FIG. 3 is a perspective view of the heat pump of FIG. 1 shown with side panels and compressor enclosure omitted to show the arrangement of some of the main components of the heat pump within the heat pump housing.
Figure 5:
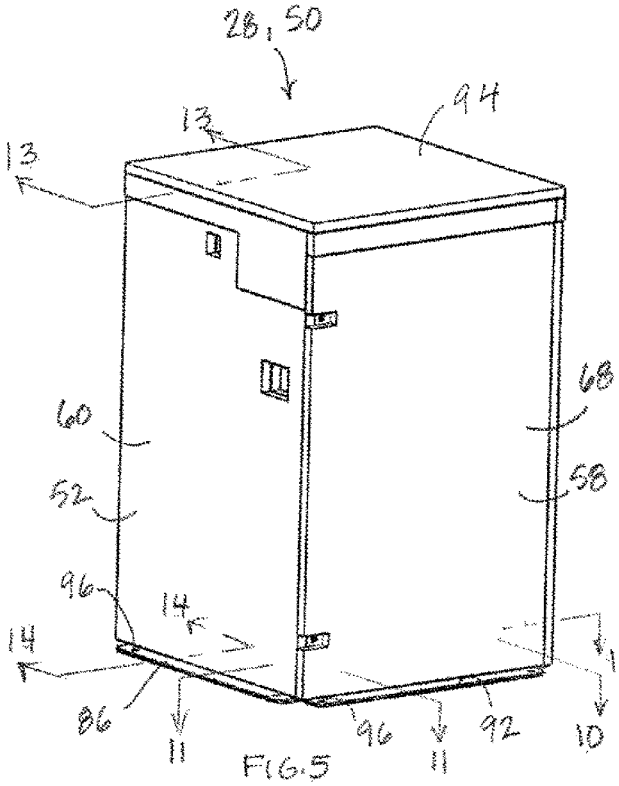
FIG. 5 is a perspective view of the compressor enclosure as seen facing the first and fourth sides of the enclosure.
Figure 6:
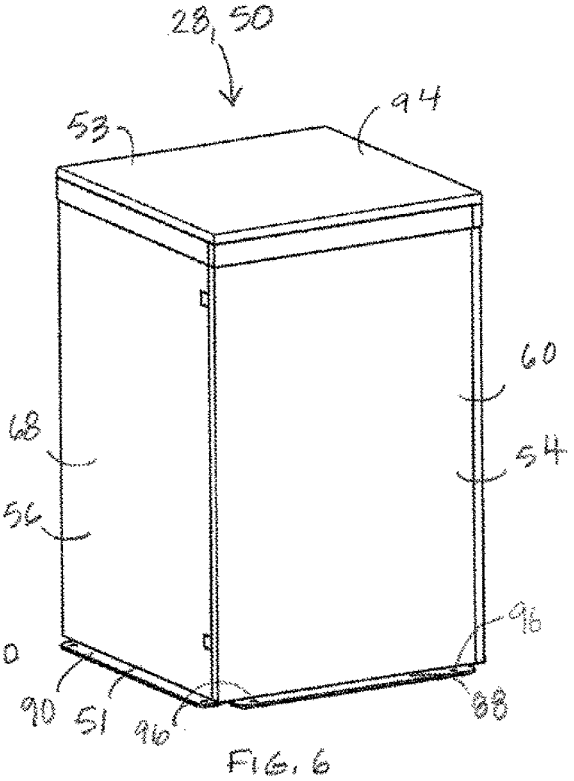
FIG. 6 is a perspective view of the compressor enclosure of FIG. 5, as seen facing the second and third sides of the enclosure.
Figure 7:
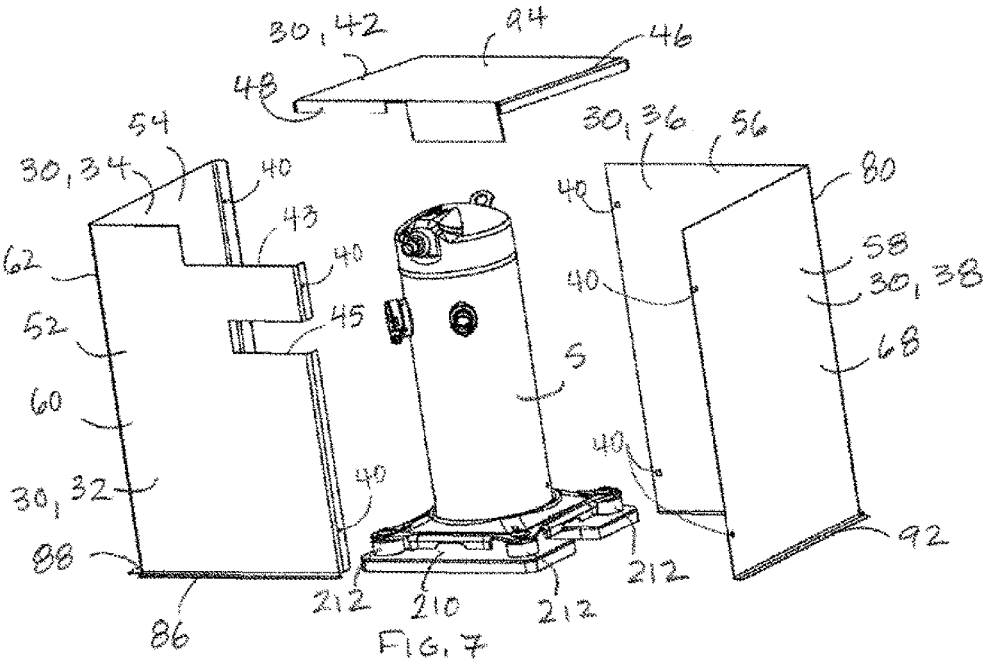
FIG. 7 is an exploded perspective view of the compressor enclosure of FIG. 5, shown including the compressor.

Referring to FIGS. 1-4, an environmental control unit such as a heat pump 2 may be used to control the environment within a closed space such as the interior of a building 1 by providing heating and/or cooling functions. The heat pump 2 is an assembly of several components, including heat exchangers 3, 4, a compressor 5, an expander 6 and a blower 7 that is configured to draw air through the heat exchanger 4. The heat pump 2 may include other ancillary components such as an air filter 11, and a controller 10 that is configured to control operation of the heat pump 2 based on input from a user via a user input device such as a thermostat 15. The heat pump 2 may also include noise reduction features that reduce the amount of noise generated by the heat pump 2 during operation. The noise reduction features include an enclosure 28 that receives and encapsulates the compressor 5 and reduces the amount of noise emitted from the compressor 5, as discussed in detail below.

Heat pumps are made in many configurations, and the following description of the heat pump 2 is exemplary in nature and non-limiting.

The heat pump 2 is a water source heat pump that includes a fluid circuit in the form of a reversible cooling/heating loop 9. The reversible cooling/heating loop 9 permits the heat pump 2 to be switchable between heating and cooling functions. To this end, the heat piup 2 includes a water-to-refrigerant heat exchanger 3 and an air-to-refrigerant heat exchanger 4 that may function either as an evaporator or a condenser depending on the heat pump operation mode. For example, when heat pump 2 is operating in cooling mode (FIG. 1), the water-to-refrigerant heat exchanger 3 functions as a condenser, releasing heat to the water, while the air-to-refrigerant heat exchanger 4 functions as an evaporator, absorbing heat from the ambient air. When heat pump 2 is operating in heating mode (FIG. 2), the water-to-refrigerant heat exchanger 3 functions as an evaporator, absorbing heat from the water, while the air-to-refrigerant heat exchanger 4 functions as a condenser, releasing heat to the ambient air. The heat pump 2 will be described herein as though configured to perform a cooling function within the building 1. In addition, the heat pump 2 includes a reversing valve 12 that is positioned in the loop 9 between the heat exchangers 3, 4 to control the direction of refrigerant flow and thereby to switch the heat pump 2 between heating mode and cooling mode. In the illustrated example, the reversing valve 12 is controlled by the controller 10 via, for example, a solenoid 13.

In the illustrated embodiment, the heat pump 2 includes an air-to-refrigerant heat exchanger 4. The air-to-refrigerant heat exchanger 4 is an air coil unit having fluid circuits comprised of serially-connected thermally conductive tubes (not shown). The air-to-refrigerant heat exchanger 4 is mounted in an air inlet 24 provided on one side of the heat pump housing 20. An air filter 11 overlies the air inlet 24. Air is drawn into the heat pump housing 20 through the air filter 11 and the air coil unit of the heat exchanger 4 via a blower 7 that is also disposed in the heat pump housing 20 adjacent to the heat exchanger 4. The blower 7 is driven by blower motor 8 and discharges air from the heat pump housing 20 via an air outlet 25.

The compressor 5 may be any suitable compressor such as a screw compressor, reciprocating compressor, rotary compressor, swing link compressor, scroll compressor, or turbine compressor.

The expander 6 may be, for example, a thermal expansion valve (TXV) 6, and is positioned in the loop 9 between the water source heat exchanger 3 and the air source heat exchanger 4. The TXV 6 is configured to decrease the pressure and temperature of the refrigerant before it enters the evaporator. The TXV 6 may also regulate the refrigerant flow entering the evaporator so that the amount of refrigerant entering the evaporator equals, or approximately equals, the amount of refrigerant exiting the evaporator.

In the illustrated embodiment, the fluid that passes through the loop 9 is a refrigerant, although it is not limited thereto. The refrigerant may be any fluid that absorbs and extracts heat.

During a cooling operation, the refrigerant enters the air-to-refrigerant heat exchanger 4 (e.g., the evaporator) as a low temperature and pressure liquid. Some vapor refrigerant also may be present as a result of the expansion process that occurs in the TXV 6. The refrigerant flows through the air-to-refrigerant heat exchanger 4 and absorbs heat from the air, changing the refrigerant into a vapor. After exiting the evaporator, the refrigerant passes through reversing valve 12 and into the compressor 5. The compressor 5 decreases the volume of the refrigerant vapor, thereby, increasing the temperature and pressure of the vapor. After exiting from the compressor 5, the increased temperature and pressure vapor refrigerant flows into the water-to-refrigerant heat exchanger 3 (e.g., the condenser). In the water-to-refrigerant heat exchanger 3, the refrigerant vapor flows into the water coil while the blower 7 draws air across fins (not shown) of the water coil. The heat from the refrigerant is transferred to the air causing the refrigerant to condense into a liquid. After exiting the water-to-refrigerant heat exchanger 3, the liquid refrigerant flows through the TXV 6 and returns to the air-to-refrigerant heat exchanger 4 (e.g., the evaporator) as a low temperature and pressure liquid, where the cooling process begins again.

A motor 16 drives the compressor 5 and circulates refrigerant through the loop 9. The operation of the compressor motor 16 is controlled by the controller 10. The controller 10 receives information from the input device 15 and a temperature sensor 14, and uses the information to control the operation of heat pump 2 in both cooling mode and heating mode. In addition, the controller 10 uses information received from the input device 15 to switch the heat pump 2 between the heating mode and the cooling mode. For example, if the input device 15 is set to the cooling mode, the controller 10 will send a signal to the solenoid 13 to place reversing valve 12 in an air conditioning position. Consequently, the refrigerant will flow through reversible loop 9 as described above. If the input device 15 is set to the heating mode, the controller 10 will send a signal to the solenoid 13 to place the reversing valve 12 in a heating position. Consequently, the refrigerant will flow through the reversible loop 9 as follows: the refrigerant exits compressor 5, is condensed in the air-to-refrigerant heat exchanger 4, is expanded in the TXV 6, and is evaporated in the water-to-refrigerant heat exchanger 3.

The controller 10 may execute hardware or software control algorithms to monitor and regulate heat pump 2. In some exemplary embodiments, the controller 10 may include an analog to digital (A/D) converter, a microprocessor, a non-volatile memory, and an interface board.

The heat pump housing 20 includes a closed first end or bottom 21 corresponding to an end of the heat pump 2 that rests on a support surface such as the ground, a floor or a shelf. The heat pump housing 20 includes a closed second end or top 22 that is opposed to the first end 21, and a sidewall (omitted from the drawings to permit visualization of the heat pump interior) that extends between the first and second ends 21, 22. The air inlet 24 is provided in the sidewall at a location that is closer to the second end 22 than the first end 21, and the air outlet 25 is provided in the second end 22. The air-to-refrigerant heat exchanger 4 is disposed in the heat pump housing 20 at a location corresponding to the air inlet 24, and the blower 7 is disposed adjacent to the air-to-refrigerant heat exchanger 4 and is connected to the air outlet 25. The blower 7 may be, for example, a squirrel cage blower. The blower 7 draws air into the heat pump housing 20. Air drawn into the heat pump housing 20 via the air inlet 24 passes through the air filter 11 and then the coils of the heat exchanger 4. Air conditioned by the air-to-refrigerant heat exchanger 4 is drawn into an inlet of the blower 7, and then exhausted from the housing air outlet 25. In the illustrated embodiment, the compressor 5 is disposed in the heat pump housing 20 at a location that is below the air-to-refrigerant heat exchanger 4 and the blower 7, and rests on an inner surface of the heat pump housing first end 21.

The heat pump 2 includes noise reduction features that mitigate noise generated by the compressor 5. The noise reduction features include floating baseplate 210, which is a sheet of noise attenuating material that is provided between the compressor 5 and the inner surface of the heat pump housing first end 21. For example, the noise attenuating material used to form the floating baseplate 210 may be rubber or a dense, closed cell foam. The noise reduction features may also include providing elastic grommets 212 between the compressor 5 and the floating baseplate 210 (or, alternatively, between the compressor 5 and the heat pump housing first end 21 with the floating baseplate 210 omitted), and the fasteners 214 that are used to secure the compressor 5 to the floor of the heat pump housing 20 extend through the grommets 212 and the floating baseplate 210. The floating baseplate 210 and the grommets 212 dampen the transmittal of compressor vibration to the heat pump housing 20.

Referring to FIGS. 3-6, the noise reduction features further include a noise-reducing enclosure 28 that is shaped and dimensioned to receive and enclose the compressor 5. In particular, the enclosure 28 is a rectangular tube having an open first end 51 that is secured to the housing first end 21, and closed second end 53 that is opposed to the first end 51 and overlies an upper end of the compressor 5. The enclosure 28 is elongated in that its height is greater than its length or width. As used herein, the height of the enclosure 28 corresponds to the distance between the enclosure first end 51 and the enclosure second end 53. For example, in the illustrated embodiment, the height of the enclosure 28 is about twice the length of both the length and width of the enclosure 28.

The enclosure 28 surrounds the sides and upper end of the compressor 5 and provides sufficient structural mass to minimize or avoid propagation of noise radiated from the compressor 5 through the walls of the heat pump housing 20, as discussed below. In addition, the enclosure 28 is constructed to minimize air leaks and is secured to the heat pump housing first end 21, as discussed below, creating a substantially air tight structure, which further improves the effectiveness of the sound reduction provided by the enclosure 28.

The enclosure 28 is an assembly of three portions, including a first angled wall portion 60, a second angled wall portion 68 and a cap portion 94. The angled wall portions 60, 68 and the cap portion 94 are easily connected to each other and, once connected, are easily detached from each other. The detachability of the angled wall portions 60, 68 from each other and from the cap portion 94 is advantageous since it permits the enclosure 28 to be removed from the compressor 5, for example to allow the compressor 5 to be serviced.

The first angled wall portion 60 provides a first side 52 and a second side 54 of the enclosure 28, whereas the second angled wall portion 60 provides a third side 56 and a fourth side 58 of the enclosure 28.

Referring to FIGS. 7-14, each portion 60, 68, 94 of the enclosure 28 is a multi-layer structure that includes a rigid metal shell 30, an outer insulating structure 100 fixed to an outside surface of the shell 30 and an inner insulating structure 180 fixed to an inside surface of the shell 30. The shell 30, the outer insulating structure 100 and the inner insulating structure 180 cooperate to reduce noise emitted by the compressor 5.

The shell 30 includes a shell first side 32 that provides a substrate for the enclosure first side 52, and a shell second side 34 that provides a substrate for the enclosure second side 54. The shell 30 includes a shell third side 36 that provides a substrate for the enclosure third side 56, and a shell fourth side 38 that provides a substrate for the enclosure fourth side 58. The shell 30 also includes a shell cap 42 that provides a substrate for the cap portion 94.

The shell first and second sides 32, 34 are joined at a right angle along a first common edge 62 to provide a substrate for the first angled wall portion 60. The first common edge 62 extends between the enclosure first and second ends 51, 53. The free edges 64, 66 of the first and second sides 32, 34 extend in parallel to the first common edge 62, and include side flanges 65, 67 that protrude inward. The side flanges 65, 67 include through holes 40(*a*) that receive fasteners (not shown) that are used to secure the first angled wall portion 60 to the second angled wall portion 68.

The shell third and fourth sides 36, 38 are joined at a right angle along a second common edge 80 to provide a substrate for the second angled wall portion 68. The second common edge 80 extends between the enclosure first and second ends 51, 53. The free edges 82, 84 of the third and fourth sides 36, 38 extend in parallel to the second common edge 80, and are free of flanges. The third and fourth sides include through holes 40(*b*) along the free edges 82, 84 that receive the fasteners (not shown) that are used to secure the first angled wall portion 60 to the second angled wall portion 68.

When the first angled wall portion 60 is assembled with the second angled wall portion 68, the side flanges 65, 67 of the first angled wall portion 60 abut an inner surface of the second angled wall portion 68, and the respective through holes 40(*a*), 4(*b*) are aligned. The fasteners, for example screws, are disposed in the openings whereby the first and second angled wall portions are secured together.

The shell cap 42 includes a planar end plate 44, and a rim 48 that protrudes integrally from a peripheral edge 46 of the end plate 44 toward the enclosure first end 51. For example, in some embodiments, the rim 48 may be formed by bending peripheral portions of the end plate 44. When the shell cap 42 is assembled with remainder of the shell 30, the shell cap rim 48 faces and abuts a portion of the outer surface of the first and second angled wall portions 60, 68. That is, the rim 48 faces and abuts the first and second angled wall portions 60, 68 at the enclosure second end 53 along a portion of each of the shell first side 32, the shell second side 34, the shell third side 36 and the shell fourth side 38.

Each side 32, 34, 36, 38 of the shell 30 includes a corresponding base flange 86, 88, 90, 92 that protrudes outward in a direction perpendicular to an outer surface of the enclosure 28. The base flanges 86, 88, 90, 92 are provided at the enclosure first end 51, and include through holes 96 that receive fasteners (not shown) that are used to secure the enclosure 28 to the heat pump housing first end 21. By fastening the enclosure 28 to the heat pump housing first end 21, air is prevented from moving freely between the enclosure 28 and the heat pump housing 20, which improves the effectiveness of the enclosure 28 in reducing compressor noise.

The shell first, second, third and fourth sides 32, 34, 36, 38 and the shell cap 42 are each a rigid metal sheet. For example, in some embodiments, the metal sheet may be 18GA galvanized sheet metal. The metal sheets used to provide the shell 30 are generally free of perforations, with the following exceptions: The base flanges 86, 88, 90, 92 include the through holes 96 that receive fasteners (for example, screws, not shown) that are used to secure the enclosure 28 to the heat pump housing first end 21, and the side flanges 65, 67 include through holes 40(*a*) that receive fasteners (for example, screws, not shown) that are used to secure the first angled wall portion 60 to the second angled wall portion 68. In addition, the shell first side 32 includes two cut outs 43, 45 that permit fluid lines and/or wire leads to pass through the shell 30.

The outer insulating structure 100 covers the outer surface of the shell 30 and is fixed to the outer surface of the shell 30. For example, the outer insulating structure 100 may be adhered to the shell outer surface using pressure sensitive adhesive.

The outer insulating structure 100 includes a cover first side 102 that overlies the shell first side 32 and a cover second side 104 that overlies the shell second side 34. The outer insulating structure 100 includes a cover third side 106 that overlies the shell third side 36, a cover fourth side 108 that overlies the shell fourth side 38 and a cap cover 110 that overlies the shell cap 42.

The cap cover 110 includes a cap cover plate 111 that overlies the end plate 44 of the shell cap 42. The cap cover 110 also includes cover portions that overlie the rim 48 on each side of the shell cap 42. Specifically, the cap cover 110 includes a rim cover first side 112 that overlies the rim 48 on a first side 32 of the shell 30, and a rim cover second side 114 that overlies the rim 48 on a second side 34 of the shell 30. The cap cover 110 includes a rim cover third side 116 that overlies the rim 48 on a third side 36 of the shell 30, and a rim cover fourth side 118 that overlies the rim 48 on a fourth side 38 of the shell 30. The rim cover first, second, third and fourth sides 112, 114, 116, 18 have the same size and profile as the corresponding portions of the rim 48, and are fixed to the outer surface of the rim 48.

Figure 11:
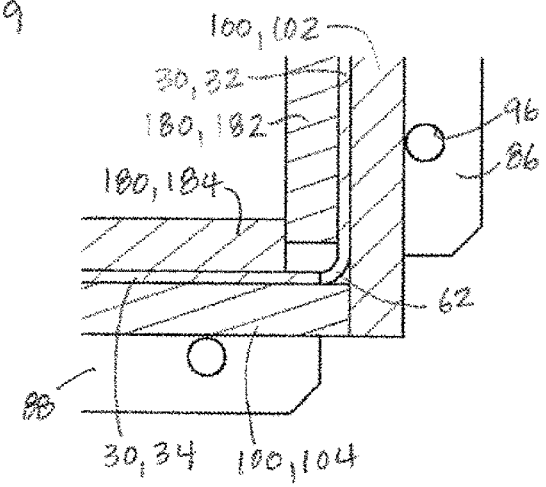
FIG. 11 is a cross-sectional view of a portion of the enclosure as seen along line 11-11 of FIG. 5.
Figure 12:
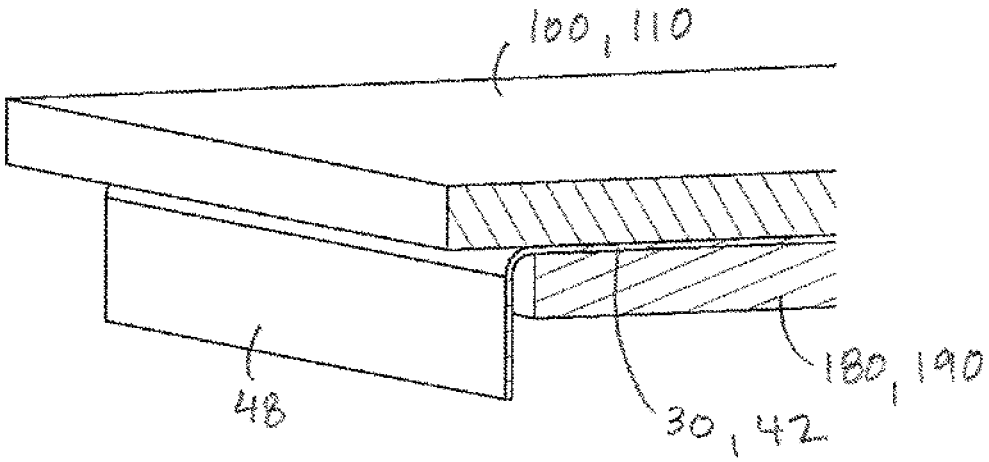
FIG. 12 is a cross-sectional view of a portion of the enclosure as seen along line 13-13 of FIG. 5, shown with the first side of the enclosure omitted.
Figure 13:
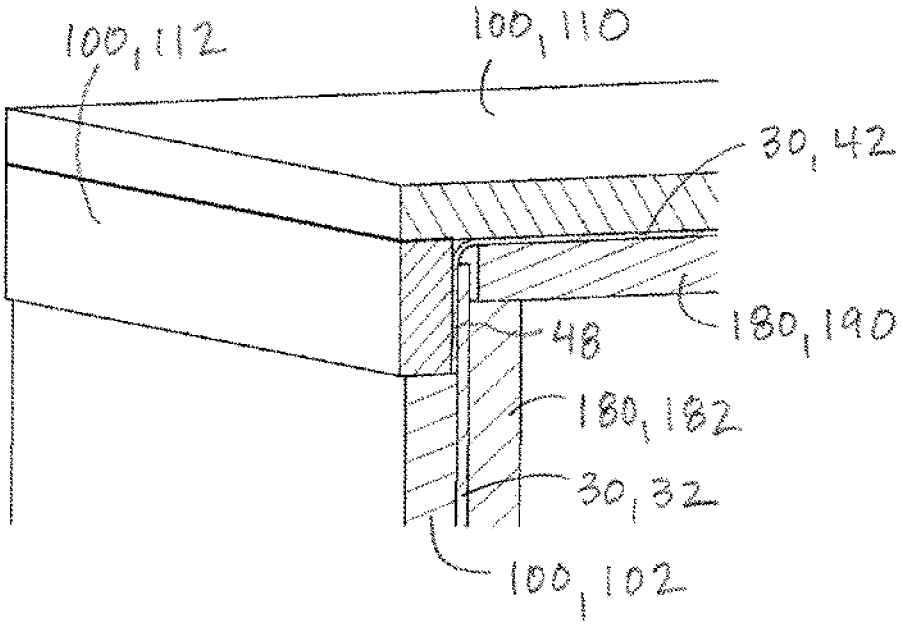
FIG. 13 is a cross-sectional view of a portion of the enclosure as seen along line 13-13 of FIG. 5, shown with the first side of the enclosure included.
Figure 14:
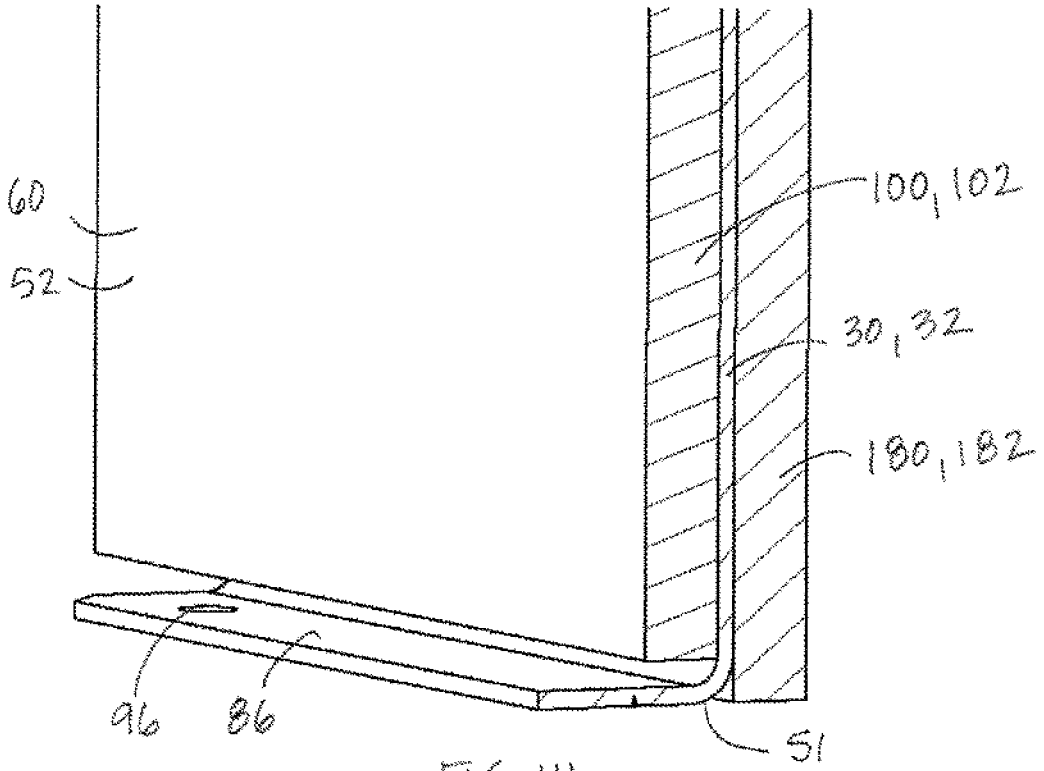
FIG. 14 is a cross-sectional view of a portion of the enclosure as seen along line 14-14 of FIG. 5.

To accommodate the presence at the enclosure second end 53 of the rim 48 and rim cover first, second, third and fourth sides 112, 114, 116, 118, the cover first, second, third and fourth sides 102, 104, 106, 108 each have a height dimension that is less than the height dimension of the shell first, second, third and fourth sides 32, 34, 36, 38 (FIGS. 11 and 12).

Figure 8:
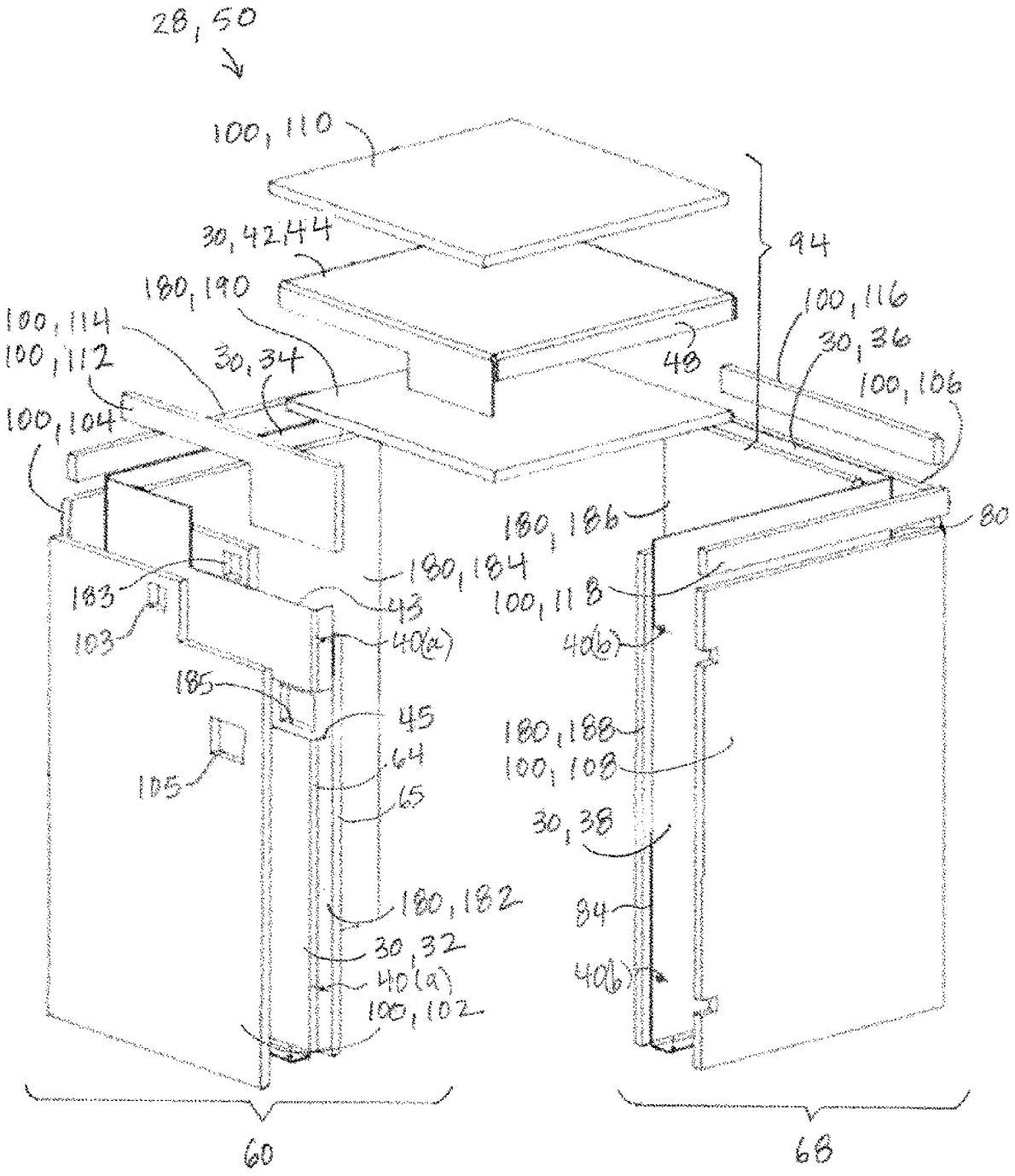
FIG. 8 is an exploded perspective view of the compressor enclosure of FIG. 5, shown with the layers of the multi-layer enclosure structure exploded and with the compressor omitted.
Figure 9:
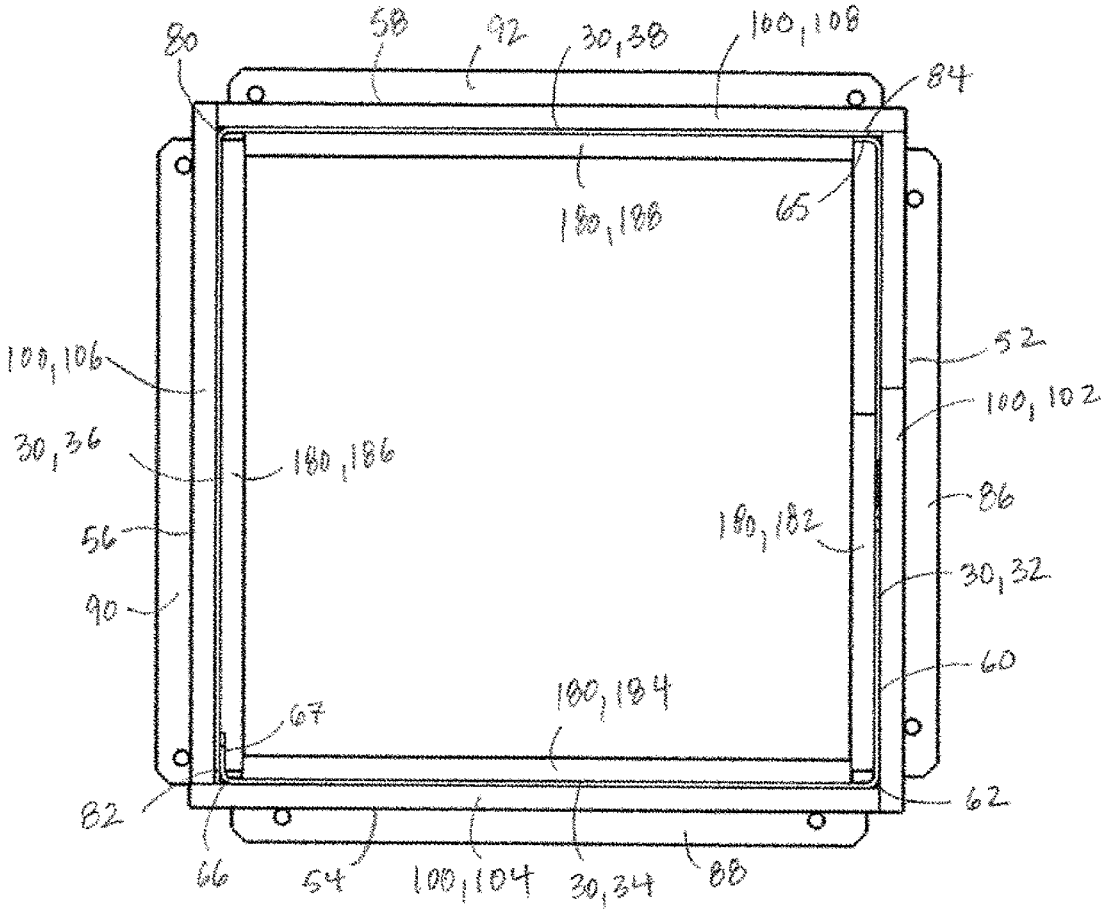
FIG. 9 is a top view of the enclosure with the enclosure cap omitted.
Figure 10:
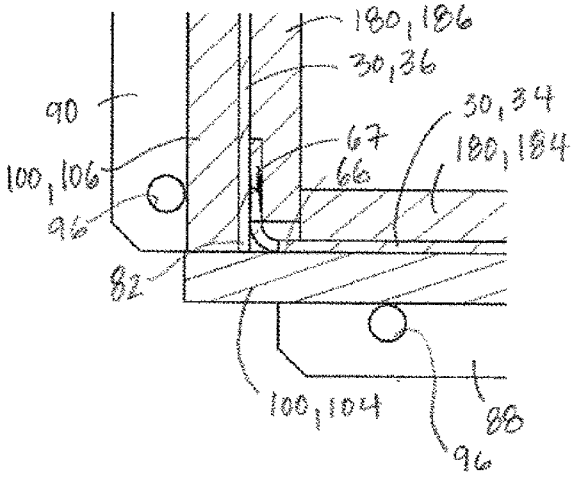
FIG. 10 is a cross-sectional view of a portion of the enclosure as seen along line 10-10 of FIG. 5.

On each side of the enclosure 28, the outer insulation structure 100 extends in the height direction between the enclosure first end 51 and the rim cover first, second, third and fourth sides 112, 114, 116, 118. The outer insulation structure 100 extends in the length and width directions a distance that is greater than the length or width of the corresponding shell side to permit butt joints to be formed between adjoining cover sides. The outer insulation structure 100 will now be described in more detail:

With respect to the enclosure first side 52, the cover first side 102 is co-planar with the rim cover first side 112. The cover first side 102 extends between the enclosure first end 51 and the rim cover first side 112, and facing edges of the cover first side 102 and the rim cover first side 112 are abutting. The rim cover first side 112 extends between the cover first side 102 and the cap cover 110 at the enclosure second end 53 (FIG. 12). At one edge, the cover first side 102 is flush with the shell fourth side 38 and forms a butt joint with an inside surface of the cover fourth side 108. At the opposed edge, the cover first side 102 protrudes beyond the shell second side 34 to form a butt joint with the cover second side 104 (FIG. 8). In addition, the cover first side 102 includes two openings 103, 105 that are aligned with the cut outs 43, 45 provided in the shell first side 32 and that permit fluid lines and/or wire leads to pass through the outer insulation structure 100. In use, insulation plugs (not shown) may be placed in the openings 103, 105 so as to reside between the fluid lines and/or wire leads and the openings 103, 105 and minimize or prevent air flow therethrough.

With respect to the enclosure second side 54, the cover second side 104 is co-planar with the rim cover second side 114. The cover second side 104 extends between the enclosure first end 51 and the rim cover second side 114, and facing edges of the cover second side 104 and the rim cover second side 114 are abutting. The rim cover second side 114 extends between the cover second side 104 and the cap cover 110 at the enclosure second end 53. At one edge, the cover second side 104 is flush with the shell first side 32 and forms a butt joint with an inside surface of the cover first side 102. At the opposed edge, the cover second side 104 protrudes beyond the shell third side 36 to form a butt joint with the cover third side 106 (FIG. 8).

With respect to the enclosure third side 56, the cover third side 106 is co-planar with the rim cover third side 116. The cover third side 106 extends between the enclosure first end 51 and the rim cover third side 116, and facing edges of the cover third side 106 and the rim cover third side 116 are abutting. The rim cover third side 116 extends between the cover third side 106 and the cap cover 110 at the enclosure second end 53. At one edge, the cover third side 106 is flush with the shell second side 34 and forms a butt joint with an inside surface of the cover second side 104. At the opposed edge, the cover third side 106 protrudes beyond the shell fourth side 38 to form a butt joint with the cover fourth side 108 (FIG. 8).

With respect to the enclosure fourth side 58, the cover fourth side 108 is co-planar with the rim cover fourth side 118. The cover fourth side 108 extends between the enclosure first end 51 and the rim cover fourth side 118, and facing edges of the cover fourth side 108 and the rim cover fourth side 118 are abutting. The rim cover fourth side 118 extends between the cover fourth side 108 and the cap cover 110 at the enclosure second end 53. At one edge, the cover fourth side 108 is flush with the shell third side 36 and forms a butt joint with an inside surface of the cover third side 106. At the opposed edge, the cover fourth side 108 protrudes beyond the shell first side 32 to form a butt joint with the cover first side 102 (FIG. 8).

On each side 52, 54, 56, 58 of the enclosure 28, the facing edges of the respective cover first, second, third and fourth sides 102, 104, 106, 108 abut the corresponding rim first, second, third, and fourth sides 112, 114, 116, 118 at a location that is between a mid-height of the enclosure 28 and the enclosure second end 53. In the illustrated embodiment, the rim 48 is narrow and thus the location is much closer to the enclosure second end 53 than to the mid height of the enclosure 28.

By this configuration, each side of the enclosure 28 is fully covered by the outer insulation structure 100, which further improves the effectiveness of the enclosure 28 in reducing compressor noise since the outer insulation structure 100 serves to both block noise and prevent airflow through the enclosure.

The inner insulating structure 180 is fixed to the inner surface of the shell 30. For example, the inner insulating structure 180 is adhered to the shell inner surface using, for example, pressure sensitive adhesive. The inner insulating structure 180 includes a liner first side 182 that underlies the shell first side 32 and a liner second side 184 that underlies the shell second side 34. The inner insulating structure 180 includes a liner third side 186 that underlies the shell third side 36 and a liner fourth side 188 that underlies the shell fourth side 38. In addition, the inner insulating structure 180 includes a cap liner 190 that underlies the shell cap 42.

On each side of the enclosure 28, the inner insulation structure 180 extends in the height direction between the enclosure first end 51 (e.g., the heat pump housing first end 21, FIG. 13) and the cap liner 190 (FIG. 12). The inner insulation structure 180 extends in the length and width directions a distance that is slightly less than the length or width of the corresponding shell side to permit butt joints to be formed between adjoining liner sides. By this configuration, each side of the enclosure 28 is fully covered by the inner insulation structure 180, which further improves the effectiveness of the enclosure 28 in reducing compressor noise since the inner insulation structure 180 serves to both block noise and prevent airflow through the enclosure. In addition, the liner first side 182 includes two openings 183, 185 that are aligned with the cut outs 43, 45 provided in the shell first side 32 and that permit fluid lines and/or wire leads to pass through the inner insulation structure 180. In use, insulation plugs (not shown) may be placed in the openings 183, 185 so as to reside between the fluid lines and/or wire leads and the openings 183, 185 and minimize or prevent air flow therethrough.

Figure 15:
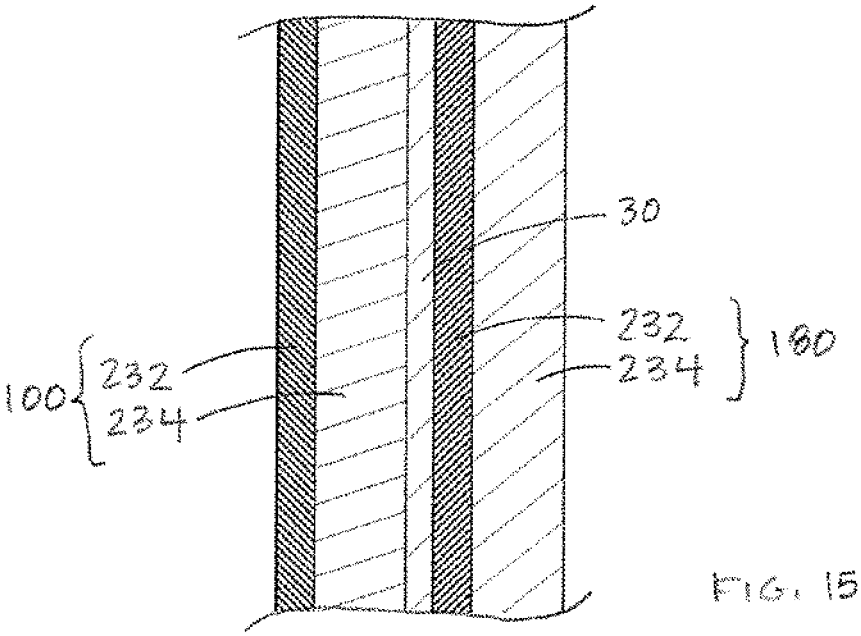
FIG. 15 is a detail view of a portion of the enclosure showing the arrangement of the layers of the inner and outer insulation structure with respect to the shell.

Referring to FIG. 15, the outer insulating structure 100 and the inner insulating structure 180 are each a multi-layer structure that includes a sheet of mass loaded plastic 232 and a layer of a foam insulation 234. As used herein, the term "mass loaded plastic" refers to a plastic that is loaded with a relatively high mass inert material. In some embodiments, the plastic is a viscoelastic plastic. In the illustrated embodiment, the plastic is polyvinylchloride (PVC, or vinyl), although other suitable plastics may be used. The inert material may be, but is not limited to, calcium carbonate or barium sulfate. The mass loaded vinyl is provided in a thin, flexible sheet that is water resistant and durable. The mass loaded vinyl serves to block sound travel, and the blocking effect of the material increases with increasing mass. In some embodiments, the mass loaded vinyl is plastic is configured to provide at least one-half pound of mass for each square foot of the sheet. In other embodiments, the mass loaded vinyl plastic is configured to provide at least one pound of mass for each square foot of the sheet.

In both the outer insulating structure 100 and the inner insulating structure, the mass loaded plastic layer is the outermost layer. In particular, the outer insulating structure 100 includes a sheet of mass loaded plastic 232 and a layer of a foam insulation 234 that is disposed between the sheet of mass loaded plastic 232 and the shell 30. The layer of foam insulation 234 of the outer insulating structure 100 is fixed to the outer surface of the shell 30. In addition, the inner insulating structure 180 includes a sheet of mass loaded plastic 232 and a layer of foam insulation 234, and the sheet of mass loaded plastic 232 is disposed between the shell 30 and the layer of foam insulation 234. The sheet of mass loaded plastic 232 of the inner insulating structure 180 is fixed to the inner surface of the shell 30.

The heat pump 2 including compressor encapsulation has been described herein in some detail as an example of how the noise reduction features can be incorporated into an environmental control unit. It is understood that the noise reduction features can be incorporated into other types of heat pumps, as well as other types of environmental control units, including, but not limited to, cooling units and/or air handling units.

Selective illustrative embodiments of the heat pump and insert are described above in some detail. It should be understood that only structures considered necessary for clarifying the heat pump and insert have been described herein. Other conventional structures, and those of ancillary and auxiliary components of the heat pump and insert, are assumed to be known and understood by those skilled in the art. Moreover, while a working example of the heat pump and insert have been described above, the system, the heat pump and insert are not limited to the working examples described above, but various design alterations may be carried out without departing from the heat pump and insert as set forth in the claims.

What is claimed is:

1. A noise-reducing enclosure for use reducing noise emitted from a compressor, the enclosure being shaped and dimensioned to receive and enclose the compressor, the enclosure comprising:

a rigid metal shell;

an outer insulating stricture fixed to an outside surface of the shell; and an inner insulating structure fixed to an inside surface of the shell, wherein the outer insulating structure comprises: a first sheet of mass loaded plastic; and a first layer of foam insulation that is disposed between the first sheet of mass loaded plastic and the shell, and the inner insulating stricture comprises: a second sheet of mass loaded plastic; and a second layer of foam insulation, and the second sheet of mass loaded plastic is disposed between the second layer of foam insulation and the shell.

2. The noise-reducing enclosure of claim 1, wherein the shell includes:

a shell first side;

a shell second side;

a shell third side; and a shell fourth side, the shell first side, the shell second side, the shell third side and the shell fourth side arranged to provide a tithe, and a shell cap that closes one end of the enclosure, the outer insulating structure includes:

a cover first side that overlies the shell first side, wherein the shell first side is tall the cover first side;

a cover second side that overlies the shell second side, wherein the shell second side is taller than the cover second side;

a cover third side that overlies the shell bird side, wherein the shell third side is taller than the cover third side;

a cover fourth side that overlies the shell fourth side, wherein the shell fourth side is taller than the cover fourth side; and a cap cover that overlies the shell cap, and the inner insulating structure includes:

a liner first side that underlies the shell first side;

a liner second side that underlies the shell second side;

a liner third side that underlies the shell third side;

a liner fourth side that underlies the shell fourth side; and a cap liner that underlies the shell cap.

3. The noise-reducing enclosure of claim 2, wherein each of the cover first side, the cover second side, the cover third side, the cover fourth side and the cap cover comprises a sheet of mass loaded plastic, and a layer of a foam insulation that is disposed between the sheet of mass loaded plastic and the shell.

4. The noise-reducing enclosure of claim 3, wherein the sheet of mass loaded plastic is configured to provide at least one pound of mass for each square foot of the sheet.

5. The noise-reducing enclosure of claim 3, wherein the sheet of mass loaded plastic is a sheet of mass loaded polyvinylchloride.

6. The noise-reducing enclosure of claim 2, wherein each of the liner first side, the liner second side, the liner third side, the liner fourth side and the cap liner comprises a sheet of mass loaded plastic, and a layer of foam insulation, and the sheet of mass loaded plastic is disposed between the shell and the layer of foam insulation.

7. The noise-reducing enclosure of claim 6, wherein the sheet of mass loaded plastic is configured to provide at least one pound of mass for each square foot of the sheet.

8. The noise-reducing enclosure of claim 6, wherein the sheet of mass loaded plastic is a sheet of mass loaded polyvinylchloride.

9. The noise-reducing enclosure of claim 2, wherein the shell first side and the shell second side are joined along a first common edge to provide a first angled wall portion, the shell third side and the shell fourth side are joined along a second common edge to provide a second angled wall portion, the first angled wall portion is detachably connected to the second angled wall portion to form the tube, and the shell cap is detachably connect to the tube.

10. The noise reducing enclosure of claim 2, wherein the shell cap comprises an end plate, and a rim that protrudes from a peripheral edge of the shell cap toward the tube, and the rim abuts an outer surface of a portion of each of the shell first side, the shell second side, the shell third side and the shell fourth side.

11. The noise-reducing enclosure of claim 10, wherein the outer insulating structure includes:

a rim cover first side that cooperates with the cover first side to cover the entirety of the shell first side;

a rim cover second side that cooperates with the cover second side to cover the entirety of the shell second side;

a rim cover third side that cooperates with the cover third side to cover the entirety of the shell third side; and a rim cover fourth side that cooperates with the cover fourth side to cover the entirety of the shell fourth side.

12. The noise-reducing enclosure of claim 2, wherein the enclosure has a first end, and a second end that is opposed to the first end and that is closed by the shell cap, the shell first side includes a first flange that is disposed at the enclosure first end and protrudes from a shell outward facing surface in a direction perpendicular to the shell outward facing surface, the shell second side includes a second flange that is disposed at the enclosure first end and protrudes from the shell outward facing surface in a direction perpendicular to the shell outward facing surface, the shell third side includes a third flange that is disposed at the enclosure first end and protrudes from the shell outward facing surface in a direction perpendicular to the shell outward facing surface, and the shell fourth side includes a fourth flange that is disposed at, the enclosure first end and protrudes from the shell outward facing surface in a direction perpendicular to the shell outward facing surface.

13. The noise-reducing enclosure of claim 1, wherein the shell, the outer insulating structure and the inner insulating structure cooperate to allow the enclosure to both block noise and prevent airflow through the enclosure.

14. An environmental control unit comprising, a housing including a first end that rests on a support surface, a closed second end that is spaced apart from the first end, a sidewall that extends between the first end and the second end, an air inlet, and an air outlet, a blower disposed in the housing, the blower configured to draw air into the housing via the air inlet and exhaust air from the housing via the air outlet, a heat exchanger disposed in the housing, a compressor disposed within housing, and noise reduction features, wherein the noise reduction features include a noise-reducing enclosure that receives the compressor, the enclosure including a rigid metal shell, an outer insulating structure fixed to an outside surface of the shell, and an inner insulating structure fixed to an inside surface of the shell, and wherein the outer insulating structure comprises: a first sheet of mass loaded plastic; and a first layer of foam insulation that is disposed between the first sheet of mass loaded plastic and the shell, and the inner insulating structure comprises: a second sheet amass loaded plastic; and a second layer of foam insulation, and the second sheet of mass loaded plastic is disposed between the second layer of foam insulation and the shell.

15. The environmental control unit of claim 14, wherein the first and second sheets of mass loaded plastic are configured to provide at least one pound of mass for each square foot of the sheet.

16. The environmental control unit of claim 14, wherein each of the first and second sheets of mass loaded plastic is a sheet of mass loaded polyvinylchloride.

17. The environmental control unit of claim 14, wherein the noise reduction features include vibration isolation structures that are disposed between the compressor and the housing.

18. A noise-reducing enclosure for use in reducing noise emitted from a compressor, the enclosure being shaped and dimensioned to receive and enclose the compressor, the enclosure comprising:

a rigid metal shell;

an outer insulating structure fixed to an outside surface of the shell; and an inner insulating structure fixed to an inside surface of the shell, wherein the shell includes:

a shell first side;

a shell second side;

a shell third side; and a shell fourth side, the shell first side, the shell second side, the shell third side and the shell fourth side arranged to provide a tube; and a shell cap that closes one end of the enclosure, the outer insulating structure includes:

a cover first side that overlies the shell first side, wherein the shell first side is taller than the cover first side;

a cover second side that overlies the shell second side, wherein the shell second side is taller than the cover second side;

a cover third side that overlies the shell third side, wherein the shell third side is taller than the cover third side;

a cover fourth side that overlies the shell fourth side, wherein the shell fourth side is taller than the cover fourth side; and a cap cover that overlies the shell cap, and the inner insulating structure includes:

a liner first side that underlies the shell first side;

a liner second side that underlies the shell second side;

a liner third side that underlies the shell third side;

a liner fourth side that underlies the shell fourth side; and a cap liner that underlies the shell cap.

* * * * *